United States Patent [19]

Roachsmith

[11] 4,021,723

[45] May 3, 1977

[54] FAIL-SAFE TRANSFORMER CIRCUIT

[75] Inventor: Humphrey Roachsmith, Corsham, England

[73] Assignee: Westinghouse Brake & Signal Company Limited, England

[22] Filed: Apr. 15, 1976

[21] Appl. No.: 677,328

[30] Foreign Application Priority Data

May 17, 1975 United Kingdom ..... 21078/75

[52] U.S. Cl. ..... 323/50; 105/61; 323/85

[51] Int. Cl.[2] ..... G05F 3/04

[58] Field of Search ..... 105/61; 180/105 E; 317/9 A, 9 AC, 18 R, 31, 60 A; 323/6, 7, 8, 44 R, 48, 50, 56, 85, 89 R, 89 C, 89 M, 89 P

[56] References Cited

UNITED STATES PATENTS

| | | | |
|---|---|---|---|
| 3,296,492 | 1/1967 | Drozdov et al. | 323/89 P |
| 3,430,025 | 2/1969 | Livshits et al. | 323/89 C |
| 3,432,741 | 3/1969 | Bishop | 323/89 R |
| 3,649,904 | 3/1972 | Bruder | 323/6 |
| 3,724,392 | 4/1973 | Maskery | 323/89 R |

*Primary Examiner*—A. D. Pellinen
*Attorney, Agent, or Firm*—J. B. Sotak; R. W. McIntire, Jr.

[57] ABSTRACT

A vital type of transformer circuit including a saturable core transducer having an input and an output winding. A source of d.c control voltage is coupled to the input winding via a four-terminal capacitor to control the impedance of the secondary winding. The output winding is coupled to a transformer having a primary, a secondary and at least one closed tertiary winding. A source of a.c. voltage is coupled through the output winding to the primary winding for inducing a.c. voltage signals in the secondary winding when d.c. control voltage is applied to the input winding and for causing the closed tertiary winding to load the transformer so that little, if any, a.c voltage is induced into the secondary winding in the absence of d.c. control voltage on the input winding.

10 Claims, 1 Drawing Figure

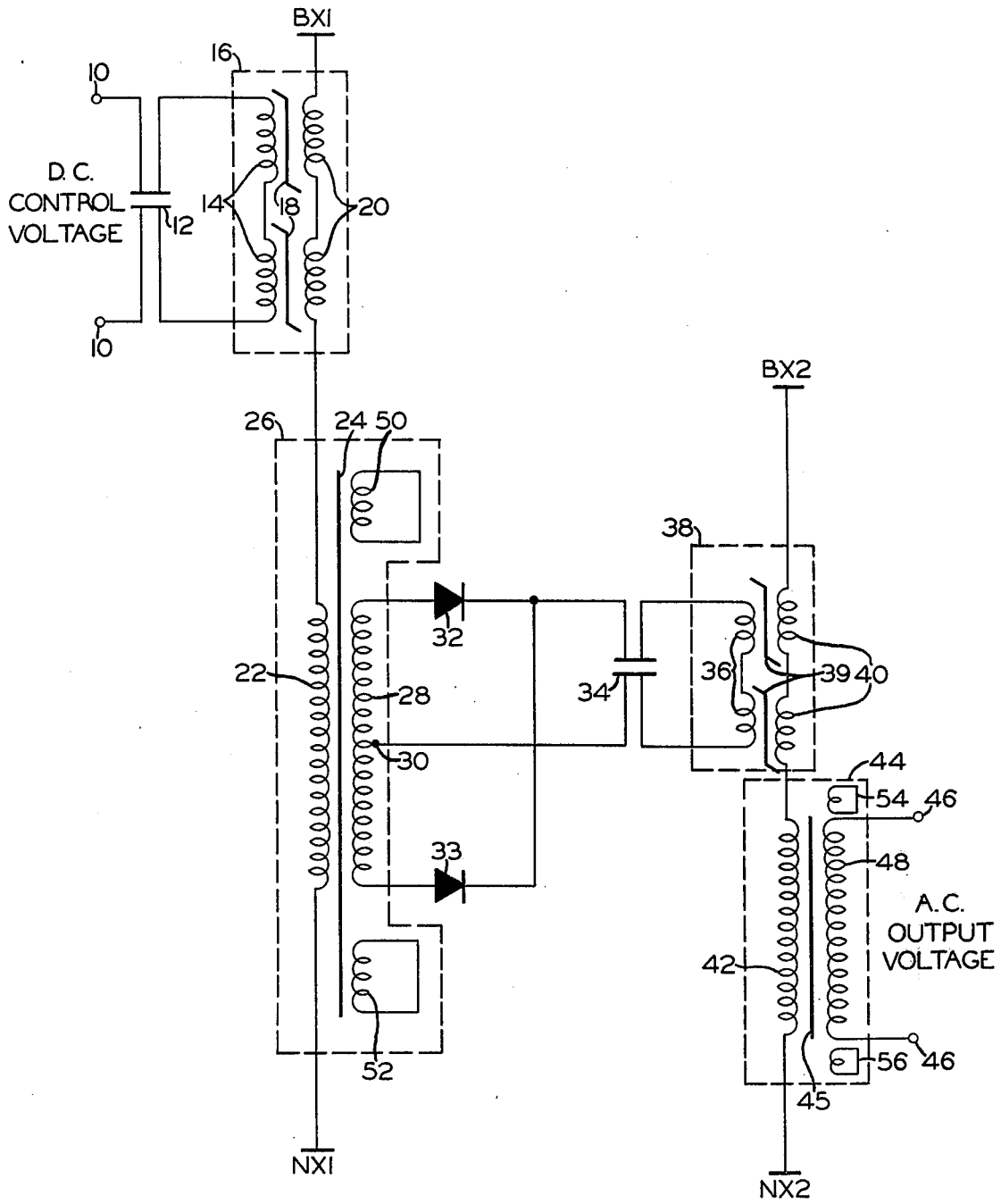
BX1
16
10
D. C.
CONTROL
VOLTAGE
12
14
18
20
10
BX2
26
24
50
38
32
22
28
34
36
39
40
30
44
54
46
33
48
A.C.
OUTPUT
VOLTAGE
42
52
56
46
45
NX1
NX2

FAIL-SAFE TRANSFORMER CIRCUIT

FIELD OF THE INVENTION

This invention relates to a vital transformer circuit and more particularly to a circuit arrangement employing a saturable core transducer means and a transformer means including at least one short circuited winding for ensuring fail-safe operation.

BACKGROUND OF THE INVENTION

In certain fields, particularly but not exclusively in railway signaling and automatic train control systems, there exists the essential requirement that electrical and electronic equipment be fail-safe which somtimes is alternatively referred to as "vital" operation. That is to say, in so far as is possible, it is mandatory that any conceivable failure or combination of related failures of any elements or components in the equipment or apparatus shall not give rise to a dangerous or unsafe condition. Purely by way of example, it is well known to arrange track circuit equipment for controlling railway signals in such a way that any failure, such as a short-circuit or open-circuit at any point in the arrangement, will cause the signals automatically to go to red stop or exhibit a "danger" signal. It is also well known to arrange components to be fail-safe per se; for example, it is common practice to provide that mating relay contacts respectively be constructed of carbon and silver in order to obviate contact welding.

As automatic train control equipment has developed, it has now become apparent that there is a necessity in certain circumstances for ensuring that a transformer circuit always presents a certain minimum load, and moreover that such a load must be fail-safe. It is quite obvious that merely connecting a resistor across all or part of a winding of the transformer is insufficient to ensure fail-safe or vital requirements since a lead of the resistor can become detached or the resistor could become open-circuited. Accordingly, it was necessary to devise a high integrity transformer load arrangement in order to satisfy the above necessity. The load arrangement in its various possible forms has wide applicability, as will subsequently be detailed, and may be employed in circumstances unconnected with railway systems and operation.

ASPECTS OF THE INVENTION

According to a first aspect of the invention, there is provided a transformer having at least first, second, and third windings mutually magnetically coupled for the transfer of electric power therebetween. One of said first and second windings forms an input primary winding of the transformer, and the other of said first and second windings forms an output secondary winding of the transformer while the third or tertiary winding may be formed of electrically conductive material having an above or greater than zero (0) resistivity. In practice, the third winding is terminated upon itself to form a continuous circuit path for circulating currents induced therein by alternating currents in said first and/or second windings.

The third or tertiary winding may obviously be a single-turn coil or winding which is preferably formed from an integral piece of material which may be in the form of a jointless ring or the like. The third or tertiary winding may be shaped to be similar to the configuration of part of a bobbin or former upon which the first and second windings are wound. For example, the shape may be a rectangular loop corresponding to an end face of a bobbin or former for use with rectangular cross-section transformer cores, and may be conveniently a suitably dimensioned sheet metal stamping. Likewise, the third winding may be a tube, preferably seamless, disposed within, between or around the first or primary and the second or secondary windings. In practice, it was found that a safe load could be achieved by employing a third or tertiary winding in conjunction with the primary and secondary windings of the transformer. In cases, where the first and second windings are small and circular, the third or tertiary winding may simply be a conductive ring or washer. In some cases, the transformer may contain a plurality of separate coils each functioning as does a third winding, e.g., the third winding may be duplicated or further multiplied, and/or more than one form of such winding may be employed in the transformer. The transformer, in addition to the first, second and third windings (together with any additional further winding or windings functioning in like manner to said third winding) may include one or more further windings magnetically coupled to the aforesaid windings such as to be capable of functioning as further input and/or output windings of the transformer. It is to be understood that any given winding nominally functioning as an input winding may, within the scope of the invention, function alternatively as an output winding, according to the connections of a power source or sources and an external load or loads, and the direction of power flow, and vice versa.

The material of the third or tertiary load winding and of each other winding functioning in like manner is preferably constructed of ductile metal such as, for example, copper, a nickel alloy, or any other suitable conductive material. A conductive metal is used, particularly, for its strength and damage-resistant properties which enhance the integrity and fail-safe capabilities of the third winding. However, it is understood that suitable non-metallic materials such as carbon and graphite and the like may be used with successful results. The dimensions and specific resistivity of the third or tertiary winding, and any other winding functioning in like manner, will be chosen such that the primarily resistive load presented by the tertiary winding, together with resistance of any other tertiary winding, will be substantially the required value of load resistance to insure fail-safe operation.

The first primary and second secondary windings, and any further windings functioning as further input or output windings, may be a mutually electrically isolated type of transformer or may be connected in an autotransformer configuration. The transformer may have a core of iron laminations, sintered or moulded ferrite, or any other suitable material, or be without a ferromagnetic core, i.e., "air-cored."

The transformer may function at any desired frequency, from very low frequencies through power frequencies and audio frequencies to very high frequencies. Effectively, there is no theoretical limit to the applicability of the invention, although practical difficulties may occur at extremes of low and high frequency. The transformer can, for example, be a power transformer, an audio frequency signal coupling transformer, or part of a filter circuit where it may be that frequency variations or other causes can reduce the load presented by the output to the input to a value which adversely affects safety. Thus, the third or tertiary winding always presents a minimum load on the transformer to positively ensure safety at all times. In using the transformer to couple a filter circuit to a load it may be preferable to arrange the resistance of the third winding to be such that it forms a substantial majority of the load on the filter whereby even extreme changes in the impedance of the external load on the filter cause only small changes in the total terminating impedance presented to the filter.

According to a second aspect of the invention there is provided a fail-safe load for a transformer having input primary and output secondary windings and including at least one closed tertiary winding composed of a conductive material having a given amount of resistance and dimensioned to present in use a substantially predetermined load to the other windings of the transformer. The form of each of the tertiary windings preferably may take the form of a multiple or single-turn loop, preferably jointless, and preferably of metal, which may be ordinary conductivity copper or any other suitable metal or alloy of higher specific resistivity. Each of the tertiary windings may be constructed of suitably gauged sheet material and approximating in plan view to an axial cross-section of the other windings. Thus, the thin ring-like tertiary windings may be used by being positioned alongside the primary and secondary windings. Such an arrangement will usually require minimal space for the tertiary winding or windings while offering the advantage of not significantly increasing the overall volume of the transformer. Where the shape and construction of the transformer permits, the tertiary winding may take the form of a closed washer or cylinder member which may be closely associated with the other windings, core or bobbin.

In another aspect of the invention, there is provided a fail-safe transformer circuit including a magnetic saturable core transducer having an input and an output winding. A transformer having a primary, a secondary and at least one closed tertiary winding is connected to the saturable core transducer. A source of d.c. control voltage is coupled to the input winding of the saturable core transducer via a four-terminal smoothing capacitor. One end of the output winding of the saturable core transducer is connected to one terminal of an a.c. voltage source while the other end of the output winding is connected to one end of the primary winding of the transformer. The other end of the primary winding is connected to the other terminal of the a.c. voltage source so that a.c. voltage signals are induced into the secondary winding of the transformer when the d.c. control voltage is applied to the input winding of the saturable core transducer and for causing the closed tertiary winding to load the transformer so the little, if any, a.c. voltage signals are induced into the secondary winding in the absence of d.c. control voltage on the input winding.

The a.c. voltage signals induced into the secondary may be applied to a full-wave rectifier network including a pair of diode rectifiers. The rectified d.c. voltage of the rectifier network is coupled via a four-terminal capacitor to the input control winding of another magnetic saturable core transducer having output controlled winding. The output winding is serially coupled to the primary winding of an output transformer. The output transformer also includes a secondary and at least one closed tertiary winding. An a.c. voltage source is coupled across the serially connected output and primary winding so that a.c. output voltage signals are induced into the secondary winding when the rectified d.c. voltage is supplied to the input control winding and for causing the closed tertiary winding to load the output transformer so that little, if any, a.c. output voltage is induced into the secondary winding in the absence of rectified d.c. voltage on the input control winding.

BRIEF DESCRIPTION OF THE DRAWING

In order that the invention may be more clearly understood and readily put into effect, a preferred embodiment of the same will now be described by way of example with reference to the accompanying drawing wherein:

The sole or single FIGURE of the drawing is a schematic circuit diagram of a practical application of a preferred embodiment of this invention.

DESCRIPTION OF A PREFERRED EMBODIMENT OF THE INVENTION

Referring now to the single figure of the drawing, there is shown a fail-safe cascaded transformer circuit arrangement which controls an a.c. output signal in accordance with a d.c. input signal.

This fail-safe circuit arrangement was developed and is basically intended for forming a vital part or portion of an automatic train control system, but it is understood, of course, that numerous other applications and uses of the invention are possible with equal success.

As shown, an input signal, such as a d.c. control voltage is applied to input terminals 10 which are connected to upper and lower plates of a four-terminal capacitor 12. The four-terminal capacitor 12 is of well known construction, and its function and purpose is to fail-safely apply the d.c. voltage to the input windings or dual control winding 14 of a conventional magnetic reactor or transductor 16. As shown, the upper and lower plates of four-terminal capacitor are connected to the respective ends of winding 14. The transducer includes a pair of magnetically saturable cores 18, each of which has a substantially rectangular hysteresis characteristic. The transducer 14 also includes output windings or dual controlled winding 20 wound on cores 18. The impedance presented by the output windings 20 of the transductor 16 varies in the well known manner in accordance with the magnitude of the direct current flowing through the input windings 14. It will be seen that the upper end of winding 20 is connected to terminal BX1 of a suitable source of a.c. voltage (not shown) while the lower end of winding 20 is connected to the upper end of primary winding 22 which in turn has its lower end connected to terminal NX1 of the a.c. voltage source. The serial connection of windings 20 and 22 permits the controlled winding 20 to control the amount of a.c. current which flows through primary winding 22. Thus, the d.c. current flowing in control winding 14 varies the magnetic flux in cores 18 which controls the impedance of controlled windings 20 and thereby varies the alternating current passing between a.c. supply terminals BX1 and NX1 and through the primary or first winding 22. The primary winding 22 is wound around the suitable magnetic core 24 of transformer 26. By way of example, the a.c. voltage supplied to terminals BX1–NX1 may have a frequency of 10 kHz, and the core 24 may be constructed from a ferrite pot core. As shown, the transformer 26 includes a second winding 28 which is also wound around the core 24 to be magnetically coupled to the primary winding 22 for the inductive interchange of electrical energy therewith. It will be noted that the secondary winding 28 is provided with a center tap 30. Thus, the secondary winding 28 provides a bi-phase output voltage which is rectified by a full-wave rectifier network including a pair of rectifying diodes 32 and 33. As shown, the anode electrode of rectifier 32 is connected to the upper end of secondary winding 28 while the anode electrode of rectifier 33 is connected to the lower end of secondary winding 33. The cathode electrodes of rectifiers 32 and 33 are connected in common and are connected to the upper plate of four-terminal capacitor 34. The center tap 30 of secondary winding 28 is directly connected to the lower plate of capacitor 34. The rectified d.c. voltage is filtered and smoothed by capacitor 34 to provide a d.c. control voltage or signal to the input windings or control winding 36 of second magnetic saturable reactor or transductor 38 which may be similar or substantially identical to the transductor 16. The magnetic transducer 38 includes a saturable core 39 illustrated as separate cores, upon which input or control winding 36 and also upon which output windings or controlled winding 40 are suitably positioned and wound in a conventional manner. In like manner to the transductor 16, the impedance presented by the output or controlled winding 40 of the transductor 38 varies in accordance with the magnitude of the direct current in the input or control winding 36. In viewing the drawing, it will be noted that the upper end of controlled winding 40 is connected to terminal BX2 of a suitable a.c. voltage source (not shown) while the lower end of winding 40 is connected to the upper end of the first or primary winding 42 of output transformer 44. As shown, the lower end of primary winding 42 is connected to the terminal NX2 of the latter a.c. voltage source. Thus, the d.c. current flowing in control winding 36, varies the magnetic flux in cores 39 which in turn controls the impedance of the controlled windings 40 and thereby varies the alternating current passing between a.c. supply terminals BX2 and NX2 and through the primary winding 42 of an output transformer 44. The transformer 44 includes a ferrite core 45 upon which both the primary and a secondary winding 48 are wound. Thus, the magnitude of the voltage appearing across a pair of output terminals 46 of the secondary winding 48 of the transformer 44 varies in dependence upon the magnitude of the d.c. signal applied to the input terminals 10.

In practice, the above cascaded transformer circuit arrangement is intended to form a vital part of a train-mounted automatic train control system where the d.c. voltage applied to input terminals 10 would be related to or derived from a frequency generator or a tachometer for indicating the actual speed of the train. Alternatively, the d.c. input voltage may be related to or derived from command signals picked up from the wayside by the train, e.g. by pickup coils which are inductively coupled to the controlled frequency rail currents. Further, the a.c. voltage signals appearing at the output terminals 46 would be connected to the braking and/or traction control equipment, such as, for example, a speed limiting governor, to effectively control the train's speed. However, the described and illustrated vital circuit arrangement may be utilized with any other electrical system under various circumstances along with other apparatus, including those unconnected with railways.

Let us assume that the d.c. signal appearing on input terminals 10 is at very low level or that it has disappeared altogether. Under this condition, the controlled windings 20 will assume a high impedance value. Moreover, if the transformer 26 was an ordinary or a conventional transformer which included only a primary winding and a secondary winding then the primary winding 22 would see the transductor 16 as a current source rather than a voltage source as is the case when a d.c. control voltage is present on terminals 10. Hence, the primary winding 22 will draw a certain amount of current on each half-cycle of the a.c. supply voltage applied to terminals BX1–NX1 and will couple it by transformer action to the secondary winding 28 which will develop a voltage up to a point at which the respective diode 32 will begin to conduct substantially. Thus, the a.c. output voltage of the transformer 26 would obviously not completely disappear or be totally cut-off even though the d.c. input signal at the terminals 10 are not present and, in fact, is cut-off completely. This condition of producing an a.c. output signal even in the absence of d.c. input signal is a clear breach of fail-safe requirements which is totally unacceptable in a vital system, such as, in an automatic train control operation. Therefore, in order to counter-act this defect or deficiency, it is necessary to follow the teaching of the present invention and to provide the transformer 26 with a pair of third and fourth windings 50 and 52, each of which is magnetically coupled to the core 24 and is mutually coupled to the primary and secondary windings 22 and 28, respectively. Each of the windings 50 and 52 is a tertiary winding which is terminated upon itself, i.e., it is closed or short-circuited wholly within the transformer 26 and is not provided with any connections external thereto. Although each of the tertiary windings 50 and 52 is schematically depicted as a short-circuited multi-turn winding which could actually be the case, it is preferred for the purpose of simplicity and maximal safety to form each of these windings as a jointless single-piece circular loop cylinder or washer which approximates or closely resembles the shape and size of the barrel or ends of the former or bobbin (not shown) upon which the windings 22 and 28 are wound and mounted. It may be assumed that the ferrite core 24 has a circular cross-section; however, it is understood that other cross-sectional shapes may be employed. In practice, the material of the loops or tertiary windings was selected to be a high resistivity nickel alloy sold by Telcon Metals Limited, under the trade mark "Pyromic," and the longitudinal, transverse and thickness dimensions were chosen in conjunction with the specific resistivity of the alloy to present the desired resistive loading for the transformer 26. In some cases, the tertiary windings may be disposed on either end of the former or spool, and in other cases, the windings may be situated between the former or spool and the core.

The windings 50 and 52 provide a positively fixed permanent type of safe resistive load for the transformer 26 which ensures that the primary winding 22 will exhibit a relatively low impedance in the absence of a d.c. control voltage on terminals 10. That is, the maximal impedance of winding 22 will be low enough even when the output controlled windings 20 of transducer 16 assume a high impedance condition due to the absence of a d.c. voltage signal at the input terminals 10 so that the voltage developed across the primary winding 22 and, in turn, th voltage developed across the secondary winding 28 will remain at a more sufficiently low magnitude for safety requirements. That is, the a.c. voltage developed across the secondary winding 28 is below the necessary level or value at which any significant current passes through the diodes 32 so that the d.c. voltage appearing across the input control windings 36 of the transductor is effectively zero (0).

It will be seen that the second stage of the fail-safe cascaded transformer circuit is very similar to the first stage. Thus, the second stage operates in substantially the same manner to produce the same results in substantially the same way as the first stage. The transformer 44 includes a pair of multiturn tertiary winding 54 and 56 for loading purposes in the absence of d.c. control voltage on input winding 36. Thus, little, if any, and effective zero (0) volts will appear across a.c. output terminals 46 during the absence of d.c. control voltage on input terminals 10 which conforms to fail-safe requirements. Further, an open-circuit or a short-circuit failure of capacitors 12 and 34 as well as diode 32 and 33 results in either the reduction or the elimination of the a.c. output voltage on terminals 46. The transducer and transformers may be constructed for heavy duty operation so that it is virtually impossible for a short circuit to occur between windings. It will be appreciated that the opening of any of the windings is a safe failure. Thus the present invention operates in a fail-safe manner in that any component or circuit failure is incapable of simulating a safe condition.

It is apparent that modifications and variations of the above described arrangement will occur to those skilled in the art which will come within the spirit and scope of the present invention. For example, only one tertiary winding such as the winding 50 and 52 or 54 and 56 need be provided dependent upon the resistive loading requirements though duplication enhances safety. That is, even if one of the tertiary windings 50 or 52 and 54 or 56 was to fail, fifty percent (50%) of the loading would remain. The windings 50 and 52 as well as 54 and 56, instead of being merely duplicated, could be triplicated or further multiplied. Various current controlling devices other than transductors or reactors 16 and 38 may be employed in practicing this invention. The rectifying arrangement may be other than a full-wave bi-phase arrangement, and filtering other than or additional to capacitative smoothing can be utilized. The above arrangement was particularly described. with reference to relatively high frequency a.c. signals but lower frequencies, e.g., power frequencies of fifty or sixty hertz and intermediate frequencies, e.g., of one or several hundred hertz, or of one or several kilohertz, may be employed. Still higher frequencies, e.g., above ten kilohertz, may also be employed. In the former cases the transformer core 24 would be of laminated iron rather than ferrite as in the first described arrangement, and the tertiary fail-safe load windings equivalent to the windings 50 and 52 as well as windings 54 and 56 could be one or more jointless single-piece rectangular loops assuming the core 24 to a rectangular cross-section of ordinary conductivity-grade copper, disposed on one or both ends of the former, between the former and the core, and for insulation purposes, wound with tape where it or they passed through the core. Instead of being disposed entirely round one or more limbs of the core of the transformer, the tertiary fail-safe load windings may be embedded within the core, preferably such that the cross-sectional area of the flux path through the windings is substantially greater than the cross-sectional area of the flux path around the windings. The windings will then present a high impedance until such time as the surrounding iron saturates, whereafter will present a low impedance and hence an at least partially resistive loading upon the input of the associated transformer. Thus the invention also provides a substantially non-linear transformer load arrangement. This arrangement is electrically analogous in some respects to deeply embedded rotor bars in a cage-type induction motor, e.g. a double-cage motor.

The above described invention is not to be confused with the long-known device called a slugged relay, that is, a relay whose armature winding is inductively coupled to a copper ring for delaying flux changes and hence retarding contact opening and/or closing. Slugged relays normally have a single winding with only two connections or terminals, and hence cannot act as transformers. If it can be shown that slugged relays having more than one winding are known, such devices would still not be transformers, since their sole intended purpose is as relays, and there is no intention of inductively transferring electrical energy between the windings. Moreover, slugged relays, whether having one or a plurality of windings, would be fed with direct current whereas a transformer must be supplied with alternating current such that transformer action would not occur. Typical slugs have such a low resistance that were the relay winding to be fed with alternating current, it would probably over-heat and possibly burn out. Therefore, slugged relays would not be considered for supply with alternating current. Thus slugged relays do not anticipate the present invention or make it obvious.

Having now described the invention what I claim as new and desire to secure by Letters Patent, is:

1. A fail-safe transformer circuit comprising, a transductor having input and output windings, a transformer having a primary, a secondary and at least one closed tertiary winding, said input winding of said transductor coupled to a d.c. control signal, said output winding of said transconductor and said primary winding of said transformer connected in series and connected across an a.c. supply source for inducing a.c. voltage signals into said secondary winding of said transformer when a d.c. control signal is applied to said input winding of said transconductor and for causng the closed tertiary winding of said transformer to load the transformer so that little, if any, a.c. voltage signals are induced into said secondary winding of said transformer in the absence of a d.c. control signal on the input winding of said transductor.

2. The fail-safe transformer circuit as defined in claim 1, wherein said secondary winding of said transformer is center-tapped and is connected through a pair of diode rectifiers to a filter capacitor.

3. The fail-safe transformer circuit as defined in claim 1, wherein a full-wave rectifier and a smoothing capacitor is connected across the secondary winding of said transformer.

4. The fail-safe transformer circuit as defined in claim 1, wherein a four-terminal capacitor is connected across said input winding of said transductor.

5. The fail-safe transformer circuit as defined in claim 1, wherein said input winding of said transductor includes a pair of coils.

6. The fail-safe transformer as defined in claim 1, wherein said output winding of said transductor includes a pair of coils.

7. The fail-safe transformer circuit as defined in claim 1, wherein said transformer includes at least two tertiary windings.

8. The fail-safe transformer circuit as defined in claim 2, wherein said filter capacitor is connected to the input winding of a transductor having an output winding connected in series to the primary winding of a transformer having secondary and tertiary windings.

9. The fail-safe transformer circuit as defined in claim 3, wherein said smoothing capacitor is connected to the input winding of a transductor having an output winding serially connected to the primary winding of a transformer having secondary and tertiary windings.

10. The fail-safe transformer circuit as defined in claim 1, wherein said secondary winding of said transformer supplies the a.c. voltage signals to a rectifier for producing a d.c. control signal for a transductor which controls the supply of a.c. voltage to a transformer having primary, secondary and tertiary windings.

* * * * *

UNITED STATES PATENT AND TRADEMARK OFFICE

CERTIFICATE OF CORRECTION

PATENT NO. : 4,021,723

DATED : May 3, 1977

INVENTOR(S) : Humphrey Roachsmith

It is certified that error appears in the above-identified patent and that said Letters Patent are hereby corrected as shown below:

Column 8, line 44, "transconductor" should be --transductor-- line 49, "transconductor" should be --transductor--

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademark*